US006543364B2

(12) United States Patent
Wes et al.

(10) Patent No.: US 6,543,364 B2
(45) Date of Patent: Apr. 8, 2003

(54) LESS LETHAL MULTI-SENSORY DISTRACTION GRENADE

(75) Inventors: James A. Wes, Diamond Bar, CA (US); Genyvieve A. Donne, Rolling Hills Estates, CA (US); John P. Deering, Lakewood, CA (US); Jay B. Cleckler, Long Beach, CA (US); Michael W. Zintl, Huntington Beach, CA (US)

(73) Assignee: Scientific Applications & Research Associates, Huntington Beach, CA (US)

( * ) Notice: Subject to any disclaimer, the term of this patent is extended or adjusted under 35 U.S.C. 154(b) by 0 days.

(21) Appl. No.: 10/077,625

(22) Filed: Feb. 14, 2002

(65) Prior Publication Data

US 2002/0108526 A1 Aug. 15, 2002

Related U.S. Application Data

(60) Provisional application No. 60/269,139, filed on Feb. 15, 2001.

(51) Int. Cl.[7] ..... F42B 12/20
(52) U.S. Cl. ..... 102/490; 102/482; 102/487
(58) Field of Search ..... 102/482–490; 89/1.14

(56) References Cited

U.S. PATENT DOCUMENTS 3,855,933 A * 12/1974 Messineo ..... 102/476
3,964,391 A * 6/1976 Zacharin ..... 102/388
4,178,851 A * 12/1979 Brady ..... 102/393
4,492,166 A * 1/1985 Purcell ..... 102/384
4,700,628 A * 10/1987 Varmo ..... 102/334
4,981,079 A * 1/1991 Winaver ..... 102/393
5,088,414 A * 2/1992 Vesa ..... 102/388
5,099,747 A * 3/1992 Smith ..... 89/1.13
5,561,263 A * 10/1996 Baillod ..... 102/504
5,698,815 A * 12/1997 Ragner ..... 102/502
6,021,716 A * 2/2000 Taylor ..... 102/517
6,240,849 B1 * 6/2001 Holler ..... 102/439
6,349,650 B1 * 2/2002 Brunn et al. ..... 102/368

FOREIGN PATENT DOCUMENTS

DE 79435 * 12/1919

* cited by examiner

*Primary Examiner*—Michael J. Carone
*Assistant Examiner*—Troy Chambers
(74) *Attorney, Agent, or Firm*—John J. Murphey

(57) ABSTRACT

A launchable, multi-sensory distraction grenade including a base, three outer grenade walls arranged together on the base to pivotally move from a first position, to a second position, extending outward laterally from the base in different directions, to form lateral legs to support the base after it lands on a surface, a plurality of spring fingers retaining the walls in contact with the base, at least two distraction devices mounted in the grenade for initiating an extended period of personnel distraction in the area of the grenade with its walls in their second position, a distraction device ignitor and safety trigger at least a portion of which is external the casing for controlling the ignition means.

21 Claims, 5 Drawing Sheets

LESS LETHAL MULTI-SENSORY DISTRACTION GRENADE

This application claims the benefit of U.S. Provisional Application No. 60/269,139 filed on Feb. 15, 2001.

BACKGROUND OF THE INVENTION

1. Field of the Invention

This invention relates to the field of distraction devices used for facility clearing, such as removing unwanted personnel from buildings and other structures. More particularly, it relates to a multi-sensory distraction grenade to replace or supplement the traditional flash-bang, hand-grenade used to route belligerents from hiding places but without causing lasting injury to them or anyone held by them.

2. Description of the Prior Art

The classic solution for facility clearing (to remove belligerents and/or rescue hostages) is to inject lachrymators (thrown or fired from a rifle or shotgun) or throw flash-bang grenades into the structure they occupy, followed by manned forced entry. These devices provide a small window of distraction to the belligerents but still places entry personnel at significant risk. It is thought that the effects of flash-bang grenades are too short to be effective in distracting the highly trained terrorist.

In the method of throwing devices into buildings and other hiding places, the safety lever on the projectile, such as a lachrymator cannister, is moved from the "safe" position to the "arm" position or the arming pin or other arming device is pulled or removed from the projectile. The device is then thrown into the building where, based upon the timing of the installed fuze, the device bursts open releasing the lachrymators such as tear gas. For the flash-bang grenade, the same insertion method is used, but as the canister bursts, several milliseconds of extremely loud sound and bright flashing light are produced.

In each of these prior art devices, many things can go wrong. The fuse may fail to ignite the contents of the grenade giving the belligerents time to throw it back or throw their own device at the law enforcement personnel. The device may bounce off furniture, walls or other structures and land in an area where the flash or bang or lachrymators is isolated and rendered less effective than if it were exploded in an open area. In addition, the short span of discomfort of a flash-bang grenade often renders it ineffective in structure-crowded areas like apartments, houses and the like. When using lachrymators, the gas itself may adversely affect small children and hostages located held by the belligerents and they may be harmed during use of these devices.

SUMMARY OF THE INVENTION

This invention is a launchable, multi-sensory distraction grenade in the form of an elongated, round projectile designed for short term travel through the air in a lobbing trajectory. It comprises a base and at least three thin, outer grenade walls arranged together on the base and is topped with a fusing device to form a completely enclosed grenade. The grenade walls are adapted to spring rapidly from a first position, where they are in sealed configuration with each other on the base of the grenade, to a second position, extending laterally outward from the base in different directions, to form legs to support the base in an upright position after the grenade has entered the structure where the belligerents are located and has landed on a surface. A plurality of spring fingers extend from the base to the outer grenade walls for controlling the movement of the grenade walls from their first position to their second position and thereafter retain the walls in contact with the base in a supporting mode so that the inside of the grenade faces upward from an underlying support surface. In another embodiment of the invention, the grenade walls may fly off the base and the spring arms become the sole support of the base. Simultaneously with movement of the grenade walls with the spring fingers, the device takes the form of a large contraption having the grenade walls hanging from the base. This makes the device difficult to pick up and throw thus eliminating the chance that the belligerents will throw the device back at the law enforcement personnel who launched it in the first place.

At least two distraction devices, and preferably three or more, are mounted inside the grenade for undertaking an extended period (i.e., 30 seconds or so) of personnel distraction against the belligerents who are in the area of the grenade. This lengthy distraction process provides a larger window of opportunity for law enforcement personnel to enter the location of the belligerents to capture and/or neutralize them. Distraction devices can be a piercing sound device, such as a whistle, powered by burning gasses issuing from an ignited container of burning material, a strobe light, powered by the same type of burnable source, lachrymators and/or malodorants, such as tear gas, essential oils, orthochlorobenzylidene malononitrile, Mace®, sneezing powder, pepper powder, n-butyl mercaptan, pepper spray, ammonia products, skunk scent, and others dispensed by their own devices or by the burning gasses that drive the whistle or the flashing light. An ignition (fuse) means and a safety trigger make up the balance of the device. Other possible agents that can be used in this invention are color dyes, such as Yellow Jacket®, Identi-Mark®, and agents that cause vomiting and nausea, etc.

This inventive device finds use in a variety of settings. The personnel in charge of the grenade can choose the personnel distraction devices to fit the exigencies of the situation such as whether the belligerent is easily convinced to surrender, whether there are children with the belligerent, whether there are winds in the area that would make lachrymators ineffective, etc. The grenade may be opened, before launching, and the appropriate distraction device added. The inventive grenade allows changing the distraction devices at the point of use thus making it highly flexible.

Accordingly, the main object of this invention is a multi-sensory distraction grenade that is adaptable to a wide variety of situations. Other objects of this invention are a device that may be accurately fired into a belligerent's hiding place and assault the senses for an extended period of time to support subsequent law enforcement activities to capture the belligerent; a grenade that may be accurately launched by a person or by a rifle for a longer distance; a grenade that is inexpensive to make, that may be altered at the site of its use, that may have its ordinance added to or deleted in order to tailor-make it useful for any particular purpose; and, a grenade that, once fired or launched, opens to become an unmanageable device of a size that thwarts later throwing by others.

These and other objects of the invention will become more clear when one reads the following specification, taken together with the drawings that are attached hereto. The scope of protection sought by the inventors may be gleaned from a fair reading of the claims that conclude this specification.

DESCRIPTION OF THE PREFERRED EMBODIMENT

Figure 1:
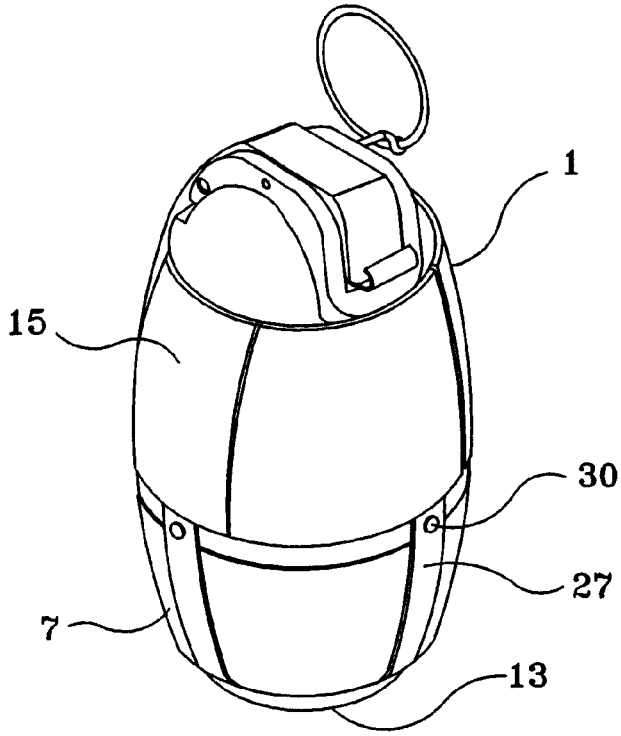
FIG. 1 is a perspective view of the preferred embodiment of the less-lethal, multi-sensory distraction invention.
Figure 2:
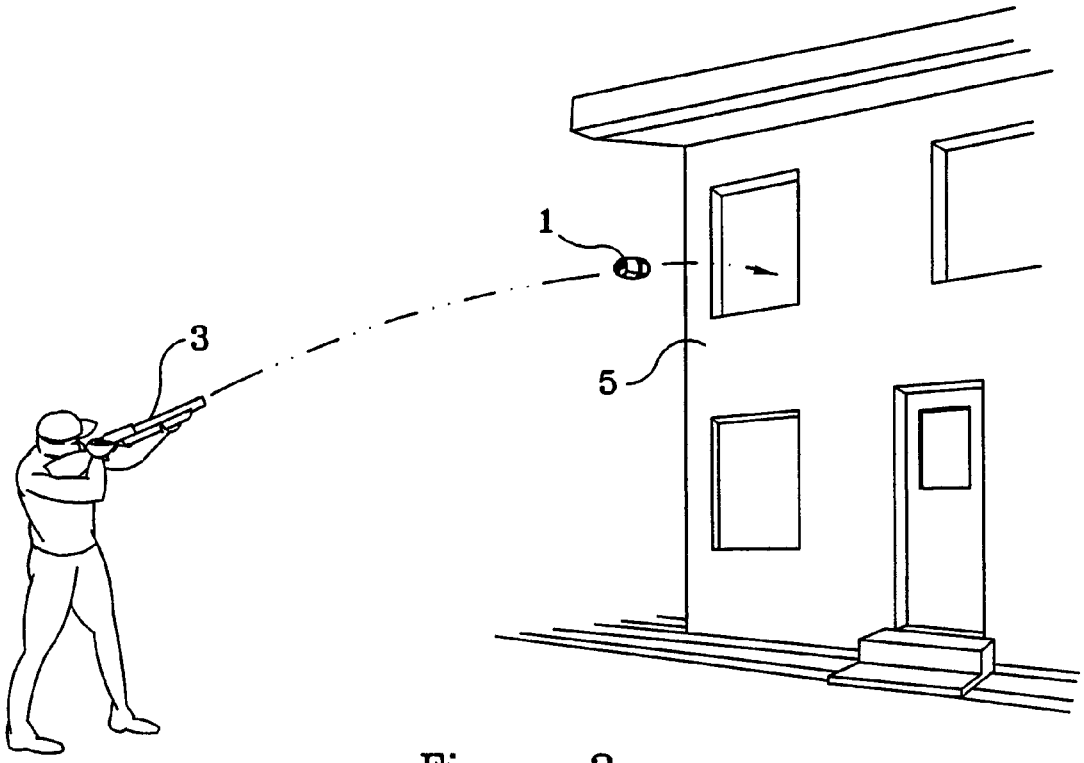
FIG. 2 is an illustrative of the inventive grenade being lobbed by a rifle into a building.
Figure 3:
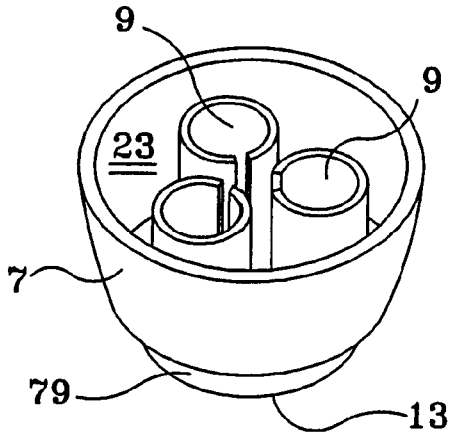
FIG. 3 is a perspective view of a typical base used in this invention.
Figure 4:
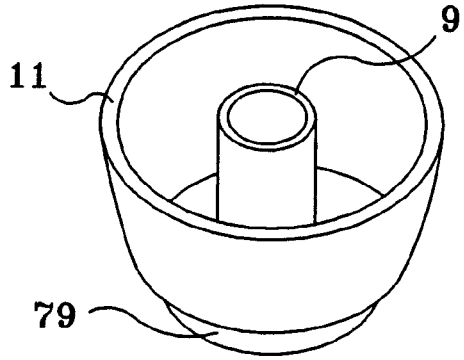
FIG. 4 is a perspective view of another typical base used in this invention.

Turning now to the drawings, where elements are identified by numbers and like elements are identified by like numbers throughout the fourteen figures, the invention depicted in FIG. 1 shows a closed launchable, multi-sensory distraction grenade 1 that is ready for launching by hand or by a rifle 3 through a window or other opening into a building 5 or cave (not shown) or other area as shown in FIG. 2. As shown in FIGS. 1, and 3–6, grenade 1 comprises a cup-like base 7, having at least one, but preferably two or more interior cups 9, each having an upwardly-facing concavity, a circular upper edge 11, and a flat bottom surface 13. Base 7 and interior cup(s) 9 are preferably made of a thick-walled, rubber-based material that is relatively easy to manufacture, such as by molding, that provides a measure of strength and will not fail or rupture when the grenade is lobbed into a structure and strikes a hard surface, such as wooden furniture, plaster walls, cave walls, or cement flooring.

Figure 5:
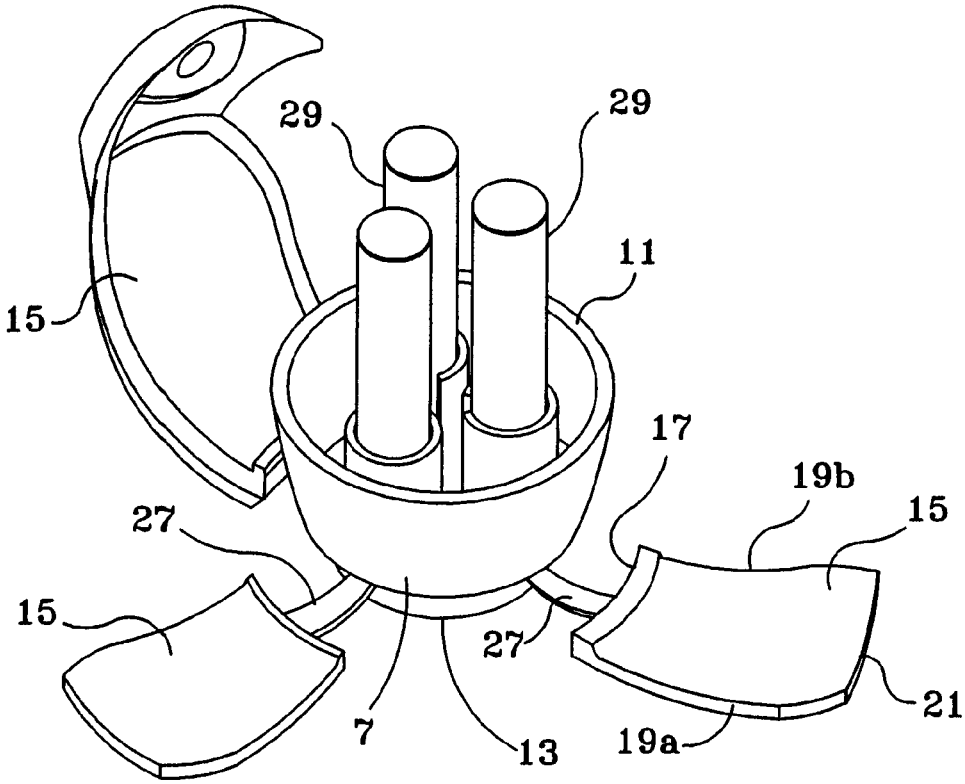
FIG. 5 is a perspective view of the invention after it opens up and the grenade walls have moved into their second position.
Figure 6:
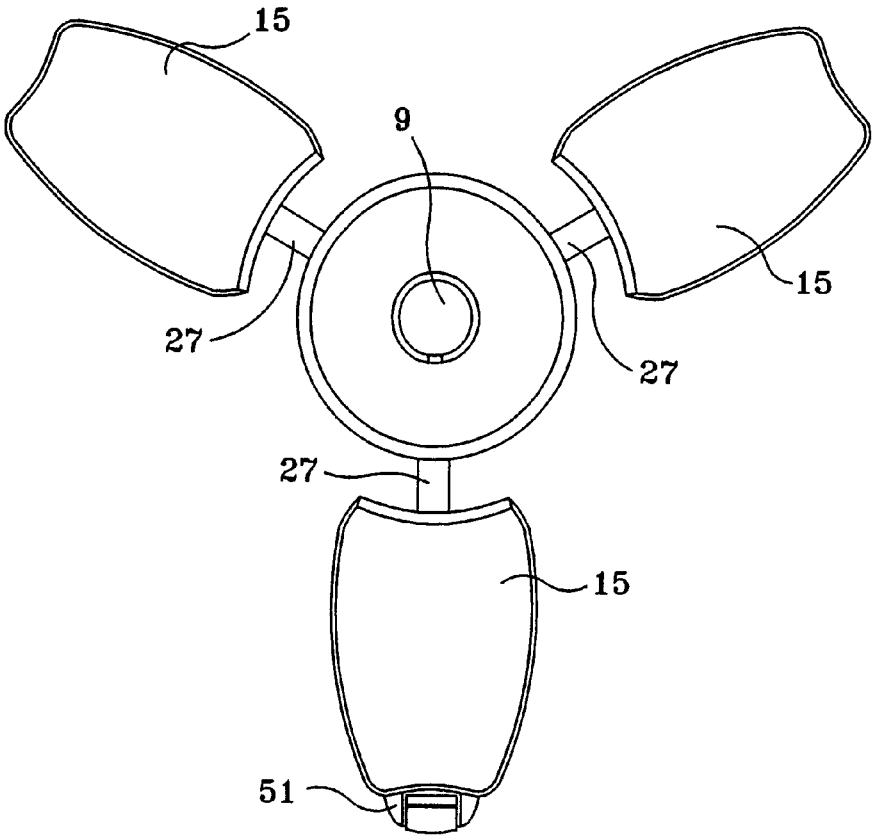
FIG. 6 is a top view of the invention after it opens up and the grenade walls have moved into their second position just as in FIG. 5.
Figure 7:
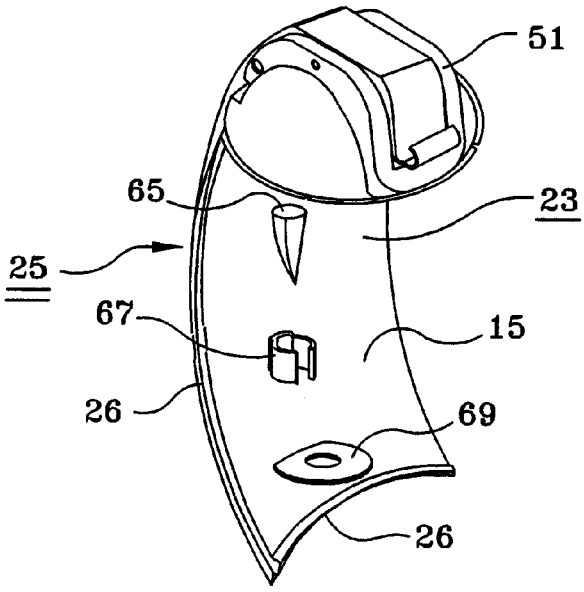
FIG. 7 is a perspective view of one of the grenade walls that has the top cap molded into it.

As shown in FIGS. 1, 5 and 6, at least three outer grenade walls 15, each defined by a bottom edge 17, two opposed side edges 19*a* and 19*b*, and a top edge 21, that are able to be arranged, in edge-to-edge fashion, to sit atop cup upper edge 11 to form a hollow interior 23. Grenade walls 15 are preferably made of the same or similar materials as base 7. As shown in FIG. 7, each grenade wall edge, i.e., bottom edge 17, side edges 19*a* and 19*b*, and top edge 21, have formed thereon abutment means 25, such as a thick strip 26 of wall material, along said edges to allow shell walls 15, when fully assembled together, to form a closed, sealed vessel.

As shown in FIGS. 1, 5 and 6, a plurality of spring fingers 27 extends outward and upward from base 7 to outer grenade walls 15 and are preferably attached thereto by rivets 30 or the like. Fingers 27 are preferably made of spring metal and are foldable into general conformance with the exterior shape of grenade 1, as shown in FIG. 1. Their function is to provide a connection between base 7 and outer grenade walls 15, to aid in holding grenade 1 together before launch and to spring outward, upon grenade 1 landing in the desired area of the belligerents, and having grenade walls 15 break free of their closed, sealed configuration, and control the movement of grenade walls 15 from a first position, in sealed configuration with each other on top of base 7, as shown in FIG. 1, and continue that elongated, rounded projectile shape during short term travel through the air in a lobbing trajectory, to a second position, as shown in FIGS. 5 and 6, extending outward laterally from base 7 in different directions, to form lateral legs to support base 7 after it lands on a surface.

Spring fingers 27 perform many vital functions in this invention. First, they supplement the interconnecting features of each grenade wall 15 and help hold them in alignment during periods of rough handling by law enforcement personnel. Secondly, they move grenade walls outward from the original configuration of grenade 1 to expose the interior of grenade 1 and allow the distraction devices to begin to function. Thirdly, they support grenade base 7 in an upright position on a floor or other surface and their extension helps prevent grenade 1 from being kicked or otherwise violently relocated from an open position on a floor to a more enclosed area such as in a closet or other such area. Finally, when expanded, they form grenade 1 into what looks like an upside-down, inverted umbrella. In this configuration, it is difficult, if not impossible, to throw grenade 1 out of the place wherein it was inserted so that it cannot be used as a weapon against the law enforcement personnel who launched it in the first place. It is preferred that spring fingers 27 be attached to grenade 1 on flat bottom surface 13 of base 7 and attached to grenade walls 15 along their outer surface, between bottom grenade wall edge 17, top wall edge 21, and in between side edges 19*a* and 19*b*.

Figure 8:
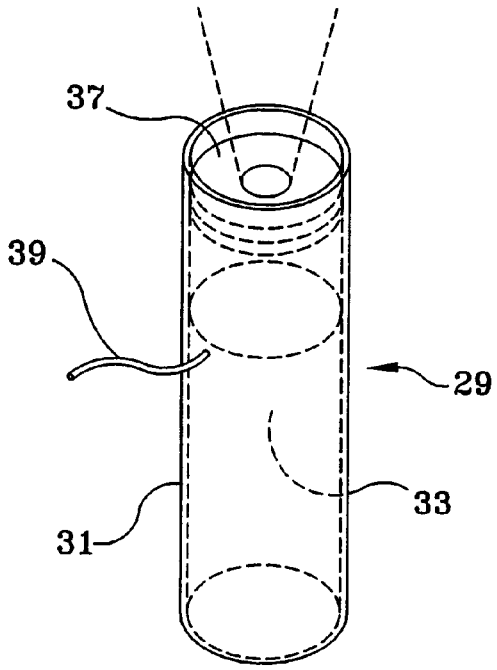
FIG. 8 is a perspective view of one of the distraction devices useful in this invention.

One or more distraction devices 29 are shown in FIG. 5 (two are actually shown) mounted inside grenade 1 in cups 9 and are exposed when grenade walls 15 move outward from their first position to their second position. A typical pyrotechnic-driven, noise distraction device 29 is shown in FIG. 8 and comprises a first hollow cylinder 31, filled with an oxidizer and an organic fuel 33. The organic fuel initially bums (reacts) with the oxidizer producing gas. A combustion product of this initial reaction forms a second fuel, which subsequently reacts with the oxidizer. This reaction happens at a rate of approximately 24,000 cycles per second. The differences in the two burn rates sends a high-low pressure wave down (up) the hollow part of cylinder 31, which in turn, acts like a Helmholtz resonator 37 (blowing across the mouth of an empty Coke® bottle). As the mixture burns downward, it leaves a larger (longer) void above it, which makes the sound "deeper" in tonal quality. These items are common in the industry.

A fuse 39 is embedded in combustible material 33 and is arranged to ignite material 33. Such a noise will continue for an extended period, depending upon the length of time it takes for combustible material to be consumed. The burning gasses keep device 29 extremely hot and this prevents the belligerent from touching it in an effort to remove it or quiet the sound.

Figure 9:
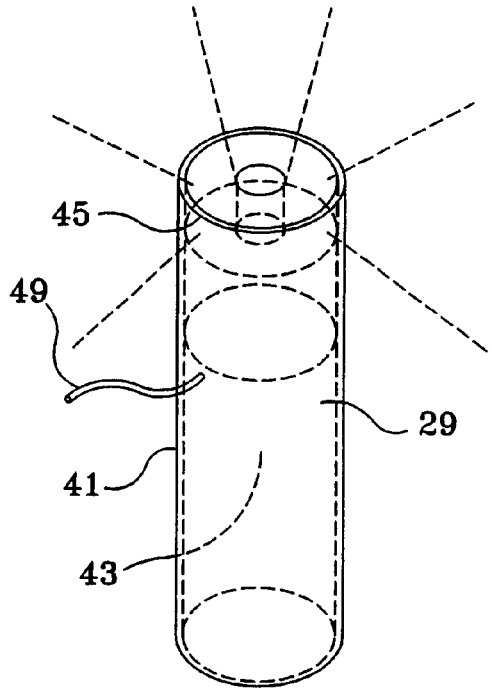
FIG. 9 is a perspective view of another of the distraction devices useful in this invention.

Another distraction device 29 is shown in FIG. 9 to comprise a hollow cylinder 41, filled with a combustible mixture 43, such as magnesium and ammonium perchlorate. The fuel and oxidizer react at a slow rate at ambient pressure. This forms a "crust" over the burning surface. This crust traps the combustion gases, which in turn, cause the fuel and oxidizer reaction to burn at a faster rate. This cycle continues until the pressure blows off the crust and resets the burning rate back to ambient pressure. The cycle repeats until the fuel is exhausted. Other such mixtures are also possible. Several other factors come into play. Additional chemicals are added to give the crust some additional strength and to make it more brittle. Then the crust breaks at a definite point and makes a sharp flash. The burn rate (and the flash rate) will speed up as the unburned mixture is pre-heated by the reaction above it. This pre-heating is adding energy to the mix (which has not yet burned), which also causes the flash rate to increase. A fuse 49 is embedded in combustible material 43 for the purpose of igniting material 43.

Other distraction devices are available and useable in this invention. For instance, lachrymators are readily available in various packages, such as small cylinders that will fit handily into cups 9 in grenade base 7, and can be fused to release tear-producing substances in the area surrounding grenade 1. A more recent distraction device is a vial of butyl-mercaptan, a dark liquid chemical characterized by a horrific strong sulfur odor that tends to make persons violently ill from the slightest inhalation. Such material is commonly referred to as a "malodorant". It has been found extremely effective in clearing caves of hiding belligerents and terrorists. Combinations of these distraction devices, such as gas-generated sound issuing devices and gas-generated light emitting devices; gas-generated sound issuing devices and malodorants; gas-generated light emitting devices and malodorants; gas-generated light emitting devices and lachrymators issuing devices; gas-generated sound issuing devices and lachrymators issuing devices; and, malodorants and lachrymators issuing devices, and others are fully contemplated in this invention.

Figure 10:
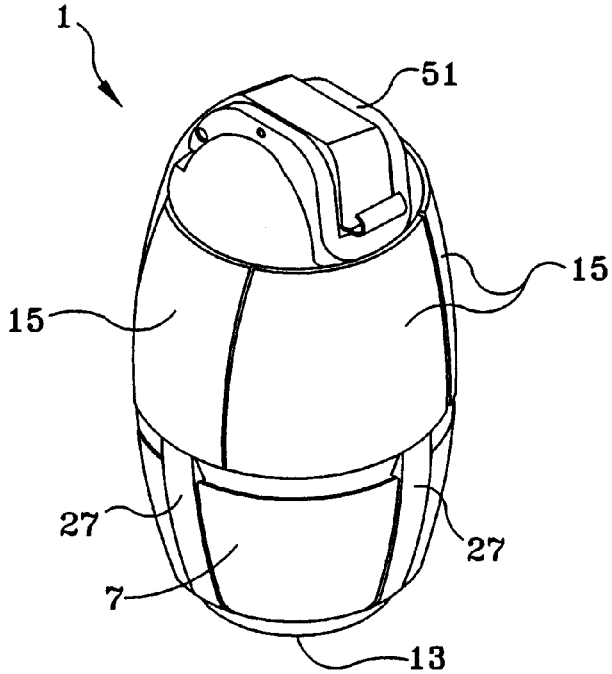
FIG. 10 is another perspective view of one of the preferred embodiments of the less lethal multi-sensory distraction grenades used in this invention.
Figure 11:
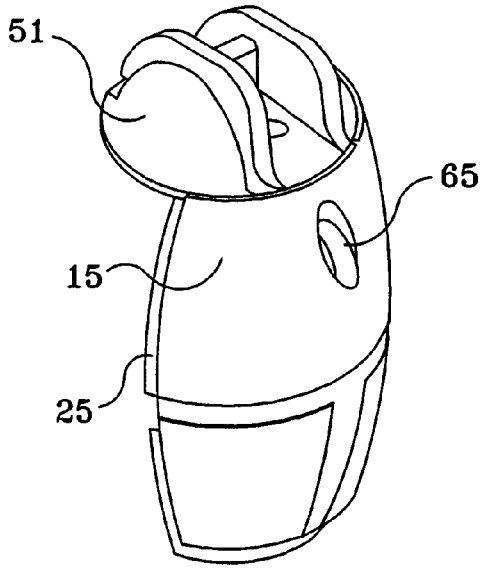
FIG. 11 is a perspective view of the outside of a grenade wall showing the aperture for inserting a vial of malodorant.
Figure 12:
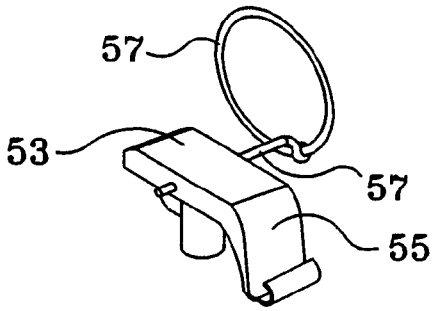
FIG. 12 is a perspective view of a typical fuse usable in this invention.

While grenade 1 may be manufactured and marketed fully assembled with various distraction devices already loaded inside thereof, it may also be made to be opened and certain desired distraction devices inserted before employing the specific grenade. A cap 51 is shown in FIGS. 7, 10 and 11 formed as part of one grenade wall 15. It can, however, be made independent of grenade walls 15 and be placed thereover after assembly of grenade walls 15. Cap 51 is preferred to be slightly pointed in outside configuration to put a slightly pointed nose to the overall configuration of grenade 1 similar to the shape of a football. Cap 51 carries a fusing device 53, as shown in FIG. 12 that includes a removable handle 55 and can be fused to cause grenade walls 15 to quickly move from their first position to their second position upon the slightest jarring, such as when grenade 1 strikes the walls or floor of the structure wherein it is launched. In addition, cap 51 includes a removable pin and ring 57 that is pulled prior to launching grenade 1 or is programmed to fly off grenade 1 during flight from the law enforcement personnel to the belligerent's area. Handle 55 may also be programed to fly off grenade 1 during its lobbing trajectory. Cap 51 may be conveniently made or cast as part of one grenade wall 15. It preferably contains the mechanism with which to activate the burning of distraction devices 29. These functions are well-known in the grenade prior art and need not be discussed further.

Figure 13:
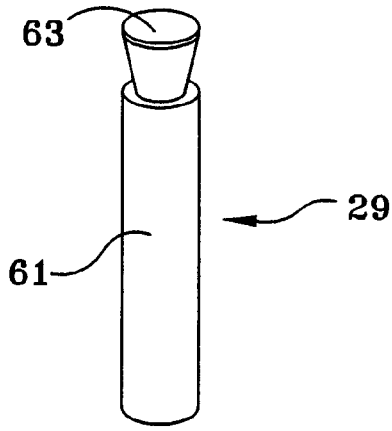
FIG. 13 is a perspective view of a typical vial of malodorant that is useful in inserting into the less lethal multi-sensory distraction grenade of this invention; and, FIG. 14 is a perspective view of the grenade of this invention positioned in a cup adapted to be fired from a rifle.

An added feature of this invention is shown in FIGS. 7, 11 and 13. In FIG. 13 is shown a small vial 61 having a cork or other stopper 63 for containing a liquid malodorant such as butyl-mercaptan. Butyl-mercaptan, as well as other mercaptans, have such a powerful stench that just one or two parts in a million of air is sufficient to cause vomiting, fainting, and other such trauma.

A small aperture 65 is formed in the upper part of one or more grenade walls 15 as shown in FIGS. 7 and 11. Interior grenade wall 15 is a small clip 67 and a resting platform 69 located below aperture 65. Vial 61 may be added to grenade 1 without opening the grenade by merely inserting the vial down through aperture 65 and through clip 67 to bottom on platform 69. This is a convenient method of adding another distraction device to grenade 1 and is far safer than loading the vial into grenade 1 at the assembly point. Butyl-mercaptan and other such malodorants are so powerful that should they leak or otherwise escape their container, they would cause extreme damage to the olefactory nerves of nearby personnel. By keeping vial 61 separate from grenade 1 before it is put in use, the margin of safety to surrounding personnel is greatly enhanced.

Figure 14:
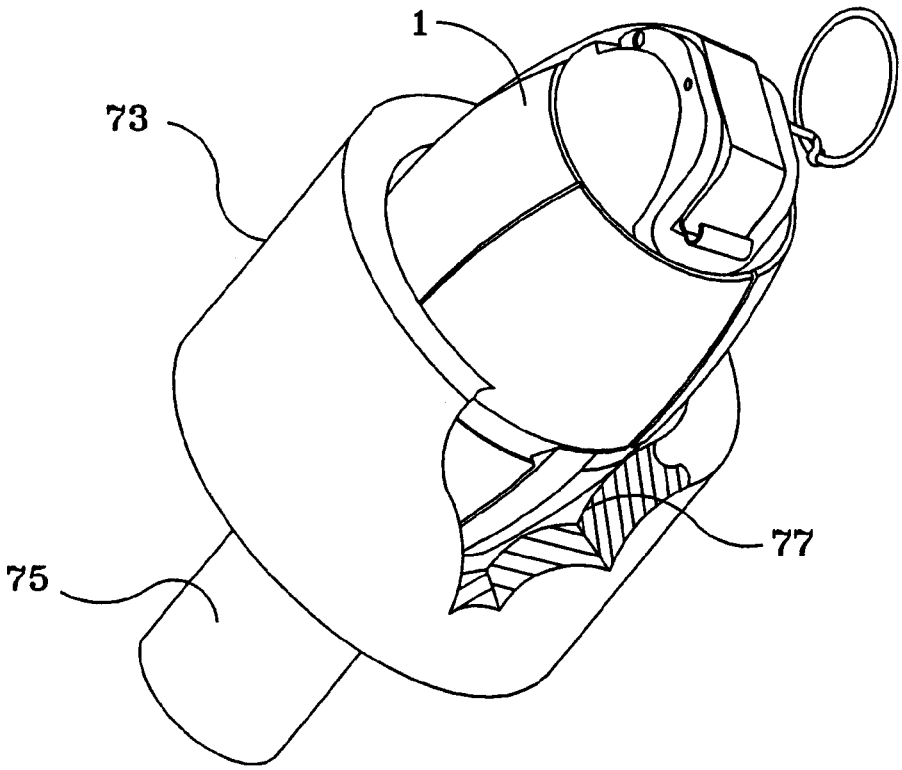

Once pin 57 has been removed from grenade 1, so that it is armed, the grenade may be loaded into a launching fixture 73, such as a cup 77 mounted on the end of a shaft 75 for insertion into the barrel of a rifle (not shown) and launched in a lobbing manner into the structure housing the belligerents as shown in FIG. 14. Before launching, pin 57 is removed from grenade 1 while handle 55 is retained in the launching fixture. After launching and during its flight, handle 55, spring-loaded for ease in removal, flies off grenade 1 so that the device becomes fully armed. As grenade 1 reaches its designated target area, fusing device 53 releases grenade walls 15 allowing spring fingers 27 to move grenade walls 15 from their first position to their second position and support base 7 upright on a surface. Distraction devices 29 would then be ignited by fusing device 53 so that the whistle would begin to sound or the light would begin to flash. Should a vial 61 of odorant be inserted in grenade 1 prior to its launch, the noxious odor would be spread by the burnt gasses billowing out of the whistle or the lamp or both. The noise and light and smell would continue as long as the combustible material continues to burn in devices 29.

It is important to have the center of gravity of grenade 1 be such that base 7 would always be biased against the supporting surface where grenade 1 came into contact. In this regard it is important for grenade 1 to have a low center of gravity and this may be achieved by installing a weight in or near base 7. Should there be three spring fingers 27 as part of grenade 1, they would be spaced apart 120°. Should four grenade walls 15 be used, then four spring fingers 27 would be needed that would be spaced apart 90°. Other number of fingers are fully contemplated in this invention.

While the invention has been described with reference to a particular embodiment thereof, those skilled in the art will be able to make various modifications to the described embodiment of the invention without departing from the true spirit and scope thereof. It is intended that all combinations of members and steps which perform substantially the same function in substantially the same way to achieve substantially the same result are within the scope of this invention.

What is claimed is:

1. A launchable, multi-sensory distraction grenade comprising:

(a) a base;

(b) at least three outer grenade walls arranged together on said base to form an enclosed grenade and adapted to move outward from a first position, in sealed configuration with each other on said base, and shaped to create an elongated, rounded projectile for short term travel through the air in a lobbing trajectory, to a second position, extending outward laterally from said base in different directions, to form legs to support said base after it lands on a surface and opens;

(c) a plurality of spring fingers extending from said base to said outer grenade walls for controlling the movement of said walls from said first position to said second position and thereafter supporting said base in an upwardly-facing arrangement from an underlying support surface and simultaneously creating a large, non-throwable device;

(d) at least two distraction devices mounted in said grenade for initiating an extended period of personnel distraction in the area of the grenade with its walls in said second position;

(e) distraction device ignition means for initiating the operative sequence of said distraction devices no earlier than when said grenade walls move from said first position to said second position; and, (f) safety trigger means at least a portion of which is external said casing for controlling the onset of said ignition means.

2. The launchable, multi-sensory distraction grenade of claim 1 wherein said spring fingers and said grenade walls remain in contact with each other following movement from said first position to said second position.

3. The launchable, multi-sensory distraction grenade of claim 1 wherein said base is terminated at its upper end by a circular edge and includes a cup having an upwardly-facing concavity for support of at least one distraction device.

4. The launchable, multi-sensory distraction grenade of claim 1 wherein said grenade forms a hollow interior.

5. The launchable, multi-sensory distraction grenade of claim 1 wherein said base is defined by a flat base surface, an outer upper edge, and said grenade walls are mounted on said upper edge when in their first position.

6. The launchable, multi-sensory distraction grenade of claim 3 wherein said outer grenade walls are designed to leave their mounting on said rim of said base when moving from said first to said second position.

7. The launchable, multi-sensory distraction grenade of claim 1 including three outer grenade walls that take up positions 120° apart, about said base, when located in their second position.

8. The launchable, multi-sensory distraction grenade of claim 1 further including spring fingers of terminal length extending equiangularly from about said base to said outer grenade walls for continuing attachment of said grenade walls to said base following movement from said first position to said second position.

9. The launchable, multi-sensory distraction grenade of claim 1 wherein said distraction devices are selected from the group consisting of:

(a) gas-generated sound issuing device and gas-generated light emitting device;

(b) gas-generated sound issuing device and a malodorant;

(c) gas-generated light emitting device and malodorant;

(d) gas-generated light emitting device and lachrymator issuing device;

(e) gas-generated sound issuing device and lachrymator issuing device; and, (f) malodorant and lachrymator issuing device.

10. The launchable, multi-sensory distraction grenade of claim 1 wherein said safety trigger means includes a portion external said casing adapted to depart said grenade during the flight of the grenade in its lobbing trajectory to arm said devices inside the grenade.

11. The launchable, multi-sensory distraction grenade of claim 1 further including means to insert a vial containing a malodorant inside said grenade without opening said outer grenade walls arranged together on said base to form a complete grenade.

12. A launchable, multi-sensory distraction grenade comprising:

(a) a base containing at least upwardly-facing cup for supporting a distraction device therein;

(b) a plurality of outer grenade walls arranged together on said base to form an enclosed grenade and adapted to move outward from a first position, in sealed configuration with each other on said base, and shaped to create an elongated, rounded projectile, having a hollow interior, for short term travel through the air in a lobbing trajectory, to a second position, extending outward laterally from said base in different directions;

(c) a plurality of spring fingers extending from said base to each said outer grenade wall for controlling the movement of said walls from said first position to said second position and thereafter retaining said walls in contact with said base to support said base in an upwardly-facing arrangement from an underlying support surface and simultaneously creating a large, non-throwable device;

(d) a distraction device mounted in said grenade for initiating an extended period of personnel distraction in the area of the grenade with its walls in said second position;

(e) distraction device ignition means for initiating the operative sequence of said distraction device no earlier than when said grenade walls move from said first position to said second position; and, (f) safety trigger means at least a portion of which is external said casing for controlling the onset of said ignition means.

13. The launchable, multi-sensory distraction grenade of claim 12 wherein said base includes a flat bottom surface on which said grenade is supported.

14. The launchable, multi-sensory distraction grenade of claim 12 wherein said base and said grenade walls are made of reinforced rubber.

15. The launchable, multi-sensory distraction grenade of claim 11 wherein said base includes an outer upper edge and said grenade walls are mounted on said upper edge when in their first position.

16. The launchable, multi-sensory distraction grenade of claim 15 wherein said outer grenade walls are designed to leave their mounting on said rim of said base when moving from said first to said second position.

17. The launchable, multi-sensory distraction grenade of claim 12 including three outer grenade walls that take up positions 120° apart, about said base, when located in their second position.

18. The launchable, multi-sensory distraction grenade of claim 12 further including spring fingers of terminal length extending equiangularly from said base to interior said outer grenade walls for continuing attachment of said grenade walls to said base following movement from said first position to said second position.

19. The launchable, multi-sensory distraction grenade of claim 11 wherein said distraction devices are selected from the group consisting of:

(a) gas-generated sound issuing device and gas-generated light emitting device;

(b) gas-generated sound issuing device and a malodorant;

(c) gas-generated light emitting device and malodorant;

(d) gas-generated light emitting device and lachrymator issuing device;

(e) gas-generated sound issuing device and lachrymator issuing device; and, (f) malodorant and lachrymator issuing device.

20. The launchable, multi-sensory distraction grenade of claim 11 wherein said safety trigger means includes a portion external said casing adapted to depart said grenade during the flight of the grenade in its lobbing trajectory to arm said devices inside the grenade.

21. The launchable, multi-sensory distraction grenade of claim 11 further including means to insert a vial containing a malodorant inside said grenade without opening said outer grenade walls arranged together on said base to form a complete grenade.

* * * * *

UNITED STATES PATENT AND TRADEMARK OFFICE

CERTIFICATE OF CORRECTION

PATENT NO. : 6,543,364 B2
DATED : April 8, 2003
INVENTOR(S) : James A. Wes et al.

It is certified that error appears in the above-identified patent and that said Letters Patent is hereby corrected as shown below:

Column 1,
Lines 3-9, should read:
-- BACKGROUND OF THE INVENTION

This invention was made with Government support under M67854-00-C-1079 awarded by U.S. Marine Corps. The Government has certain rights in the invention.

This application claims the benefit of U.S. Provisional Application No. 60/269,139 filed on February 15, 2001.

FIELD OF THE INVENTION --

Column 2,
Line 66, "Claims" should be capitalized.

Column 4,
Line 3, insert -- 31 -- before "30"
Line 48, replace "bums" with -- burns --.

Signed and Sealed this

Fifth Day of August, 2003

JAMES E. ROGAN
*Director of the United States Patent and Trademark Office*